United States Patent [19]

Frost et al.

[11] Patent Number: 4,671,194

[45] Date of Patent: Jun. 9, 1987

[54] LOOPER APPARATUS FOR EQUALIZING THE LEGS OF CUT PILE TUFTS

[75] Inventors: Stephen L. Frost, Chattanooga; Charles W. Watkins, Ooltelwah, both of Tenn.

[73] Assignee: Tuftco Corporation, Chattanooga, Tenn.

[21] Appl. No.: 884,715

[22] Filed: Jul. 11, 1986

[51] Int. Cl.[4] ..... D05C 15/24

[52] U.S. Cl. ..... 112/80.55

[58] Field of Search ..... 112/80.55, 80.52, 80.5

[56] References Cited

U.S. PATENT DOCUMENTS 2,194,876 3/1940 Sparks ..... 112/80.55

*Primary Examiner*—Ronald Feldbaum

*Attorney, Agent, or Firm*—Harrington A. Lackey

[57] ABSTRACT

A looper apparatus for a multiple needle tufting machine in which the bill of each cut pile hook is shaped to have a rear straight cutting portion and a free end portion transversely offset from the cutting portion to seize a loop from a corresponding needle and guide the loop along a path offset from the normal longitudinal row of stitching in order to extend the side of the loop on the cutting side of the hook so that, when the loop is cut, the legs of the cut pile tuft will be substantially equal.

14 Claims, 11 Drawing Figures

LOOPER APPARATUS FOR EQUALIZING THE LEGS OF CUT PILE TUFTS

BACKGROUND OF THE INVENTION

This invention relates to a tufting machine, and more particularly to a cut pile looper apparatus to form cut pile tufts having substantially equal legs.

Traditionally, cut pile has been produced in tufting machines by a reciprocable looper or hook engaging and holding a loop of yarn carried through a base fabric by a reciprocable needle, and a reciprocable knife cooperating with one side of a looper to cut the loop of yarn into two separate yarn ends or legs. As the knife reciprocates along and against one side of the looper, the yarn loop is cut on one side of the hook to form two unequal cut pile ends or legs. Such cutting is referred to in the industry as a "J-cut", because the long leg of the yarn loop is J-shaped, or because the unequal strands of the yarn segments stitched into the base fabric are J-shaped. Many manufacturers of cut pile fabrics, particularly carpets, have found the conventional "J-cut" pile to be objectionable because of the unequal height or length of the pairs of ends or legs in each cut loop, which presents an uneven pile surface.

Various means have been utilized in an attempt to eliminate the uneven and unattractive cut pile surface created by the formation of the "J-cuts". One example of such an effort is to shear the cut pile fabric with a shearing machine after the tufting operation in order to make the cut pile legs even. Usually, this procedure requires several passes of the carpet over the shearing machine.

Another method to neutralize the effect of the "J-cuts" is to alternately laterally shift the needle bar continually to create zig-zag rows of stitching which obliterate the "corduroy effect" of straight rows of "J-cuts" stitching.

Other attempts to eliminate the "J-tufts" are disclosed in the following U.S. Pat. Nos.

| | | |
|---|---|---|
| 3,662,697 | Passons et al | May 16, 1972 |
| 3,730,115 | Passons et al | May 1, 1973 |
| 3,735,715 | Passons et al | May 29, 1973 |
| 3,880,101 | Passons | Apr. 29, 1975 |
| British Patent 722,095 | Moss | May 23, 1951 |
| British Patent 782,079 | American Safety Razor Corporation | May 24, 1955 |
| British Patent 1,143,342 | Preston Engineers (Precision) Limited | Apr. 22, 1966 |

However, none of the above patents disclose a looper apparatus incorporating cut pile hooks in which the bill of the hook is bent or formed to provide a free end or pointed end portion which is transversely offset from the portion of the bill which cooperates with a knife to cut the loop.

SUMMARY OF THE INVENTION

It is therefore an object of this invention to provide a looper apparatus for a multiple needle tufting machine in which the cut pile hooks are uniquely designed to position loops seized by the hooks for cutting substantially the center of the loop, in order to form cut pile tufts having legs of substantially equal height.

Each of the cut pile hooks generally resembles a conventional cut pile hook except for the structure and shape of the bill of the hook. The bill is bent, or otherwise formed, to include a substantially straight rear or cutting portion projecting forward from the throat portion of the hook, an intermediate angular portion merging with the forward extremity of the cutting portion, and a free end portion into which the intermediate portion terminates. The free end portion is laterally offset from the straight rear portion of the bill. The free end portion of the bill is adapted to move closely adjacent one side of the needle in its lowermost position to pass through the loop formed by the needle. As the loop travels rearwardly along the bill of the hook, the loop is diverted transversely from its normal longitudinal path along with the stitch row to expand the strand or leg of the loop on the cutting side of the hook, so that when the loop is cut, the legs of the cut pile tuft will be substantially equal. The straight cutting portion of the bill projects forwardly far enough to present a planar cutting surface to the cooperating reciprocable knife.

A further object of this invention is to provide a needle plate having rearward projecting needle plate fingers extending between the needles, each finger having a straight mounting portion and a lateral or transverse offset portion. The offset portions of the fingers are laterally offset from their corresponding straight portions in the opposite direction from the offset direction of the cutting portion of a corresponding hook bill from its free end portion. The offset portions of the fingers terminate rearwardly in an area where the loops are cut by the cooperating knives and hooks. The purpose of the offset needle plate fingers is to neutralize the pulling effect of the offset hook bills which sometimes cause the entire tufted fabric to move toward one side of the tufting machine. The engagement of the tufted rows of stitching by the offset needle plate fingers tends to pull the yarns and therefore the tufted fabric laterally in the opposite direction from the pulling effect of the offset loopers.

Cut pile hooks made in accordance with this invention are adapted for use with either in-line needles or staggered needles in multiple needle tufting machines.

DESCRIPTION OF THE PREFERRED EMBODIMENTS

Figures 1, 2, 3, 4, 5:
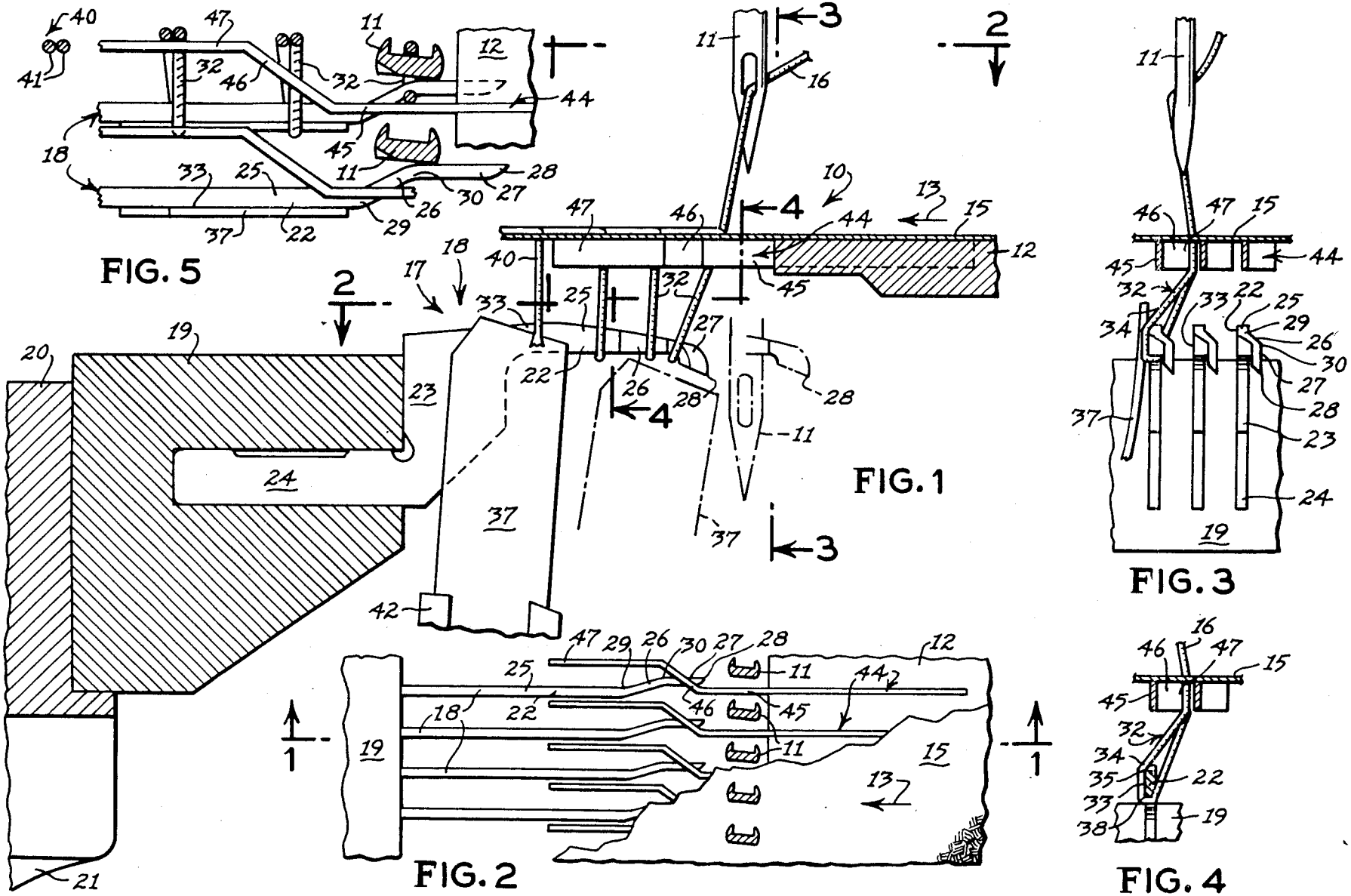
FIG. 1 is a fragmentary sectional elevation of a portion of an in-line multiple needle tufting machine incorporating this invention and disclosing the looper mechanism in a cutting position in solid lines and a loop-forming position in phantom, taken along the line 1—1 of FIG. 2.
FIG. 2 is a fragmentary sectional plan view taken along the line 2—2 of FIG. 1.
FIG. 3 is a fragmentary section taken along the line 3—3 of FIG. 1.
FIG. 4 is a fragmentary section taken along the line 4—4 of FIG. 1.
FIG. 5 is an enlarged fragmentary plan sectional view of the looper mechanism in an operative loop-forming position.

Referring now to the drawings in more detail, FIGS. 1–5 disclose a portion of a multiple needle in-line tufting machine 10 including a plurality of needles 11 disposed in a row transversely of the machine 10. The needles 11 are supported by a transverse needle bar, such as the needle bars 50 and 63 disclosed in FIGS. 6 and 8, which is operatively connected to a needle drive mechanism, not shown, for vertically reciprocating the needles 11 between the upper solid-line position and the lowermost phantom position disclosed in FIG. 1.

Supported upon a needle plate 12 for movement longitudinally from front to rear, in the direction of the arrow 13 through the tufting machine 10 is a base fabric 15. Each needle 11 carries a yarn 16 through the base fabric 15 upon each stroke of the needle 11.

The looper mechanism 17 made in accordance with this invention includes a plurality of looper elements or cut pile hooks 18 mounted transversely of the tufting machine 10 upon the same gauge as the needles 11 in a hook bar 19. The hook bar 19 is supported upon the hook shaft, not shown, through a plurality of transversely spaced brackets 20 fixed to corresponding rocker arms 21, which in turn are journaled on the rock shaft, not shown. The rock shaft is driven by conventional means, not shown, to cause limited reciprocable movement of the hook bar.

Each of the cut pile hooks 18 includes a bill 22, a throat portion 23, and a shank or mounting portion 24. The throat portion 23 and shank 24 are of the same shape and construction as their counterparts in conventional cut pile tufting hooks.

However, the bill 22 of the cut pile hook 18 made in accordance with this invention includes a straight rear or cutting portion 25 projecting forward from the throat portion 23. The forward or front end of the cutting portion merges into an angular intermediate portion 26, which in turn merges into a free end portion 27 having a pointed end 28.

Although the intermediate portion 26 of the cut pile hook 18 disclosed in FIGS. 1–5, is disclosed as being substantially straight, the intermediate portion 26 could be curved or otherwise shaped to transversely offset the pointed end 28 from the cutting portion 25. The free end portion 27 may be straight and parallel to the cutting portion 25, if desired.

The bill 22 may be formed from a conventional cut pile hook by being deformed or bent at the bend or joints 29 and 30. The front extremity of the cutting portion 25 merges with the intermediate portion 26 through the joint 29. The joint 30 joins the front extremity of the intermediate portion 26 and the free end portion 27.

As best disclosed in FIGS. 2 and 5, the free end portion 27 is offset from the straight cutting portion 25 of the bill 22. The cut pile hook 18 is mounted in the hook bar 19 in such a manner that the pointed end 28 is adapted to travel longitudinally in a path, ie. a point path, which will cross closely adjacent one side of the needle 11. The free end portion 27 crossing the needle 11 picks up or seizes the loop 32 formed by the needle 11 when it has penetrated the base fabric 15 and descended to its lowermost position, as illustrated in phantom in FIG. 1. By virtue of the lateral or transverse offset spacing of the cutting portion 25 from the free end portion 27, the loop 32 is guided rearwardly and laterally away from the normal stitch row by its movement over the angular bill 22, until the loop 32 is carried by the straight cutting portion 25, as best illustrated in FIGS. 3, 4 and 5.

Figures 6, 7, 8, 9, 10, 11:
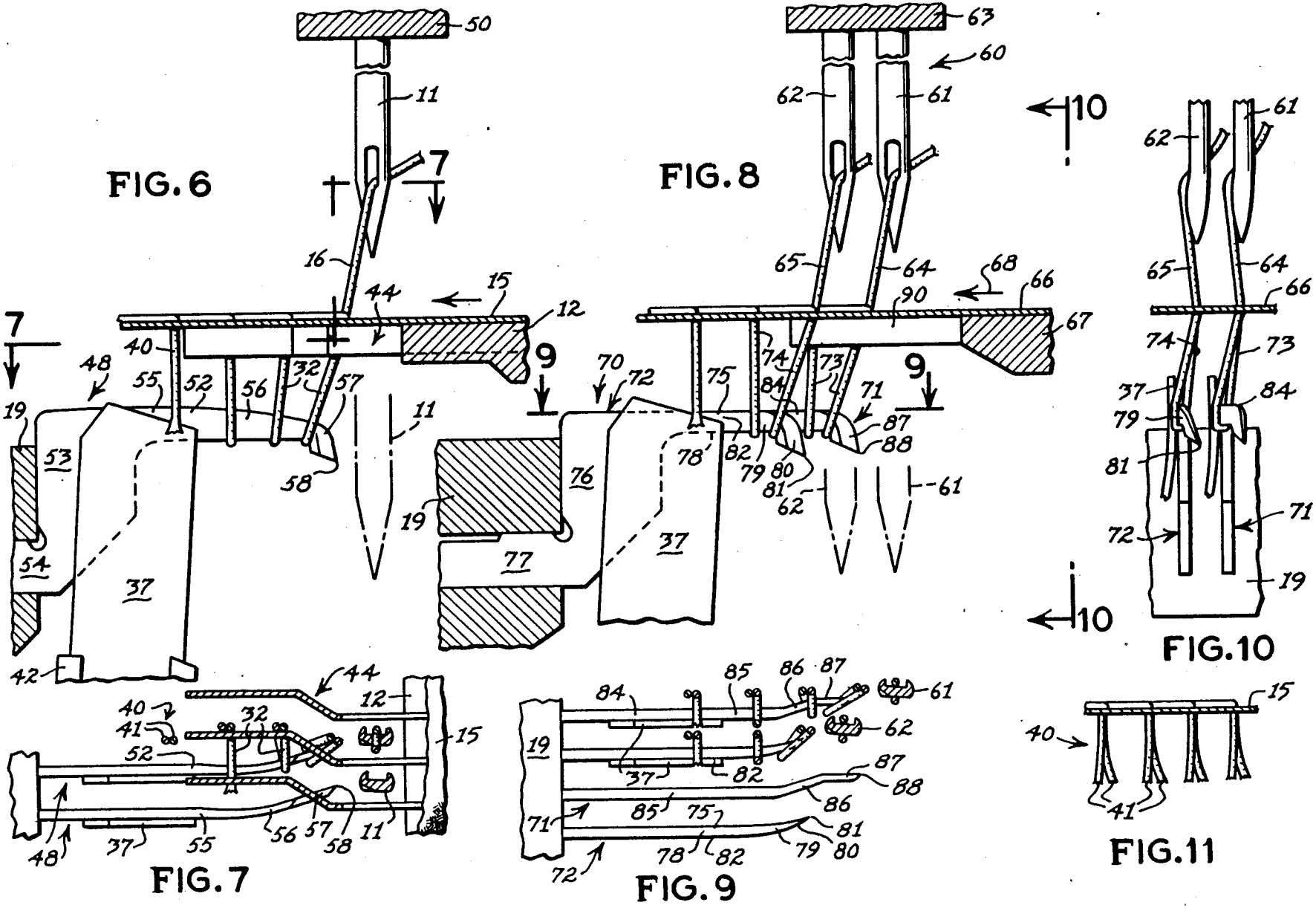
FIG. 6 is a fragmentary sectional elevation, similar to FIG. 1, illustrating a modified looper bill.
FIG. 7 is a fragmentary plan section taken along the line 7—7 of FIG. 6.
FIG. 8 is a fragmentary sectional elevation of a portion of a staggered needle tufting machine incorporating this invention, including modified cut pile hooks.
FIG. 9 is a fragmentary sectional plan view taken along the line 9—9 of FIG. 8.
FIG. 10 is a sectional elevation taken along the line 10—10 of FIG. 8.
FIG. 11 is a fragmentary sectional elevation of a cut pile tufted fabric having substantially uniform pile height, made in accordance with this invention.

The straight cutting portion 25 of the bill 22 has a flat vertical cutting surface 33 on the opposite side of the bill 22 from the needle 11. As illustrated in FIGS. 3 and 4, the cross-section of the bill 22 is such that the transverse dimension is substantially less than the vertical dimension or height of the cutting portion 25. Thus, as the loop 32 is pulled transversely out of its normal stitch path, the strand 34 of the loop 32 is extended over the upper corner 35 of the cutting portion 25. When the looper or cut pile hook 18 is retracted to its inoperative position, the knife 37 is moved upward into its shearing or cutting position against the cutting surface 33 to cut the loop 32 at the bottom cutting edge 38 of the bill 22 (FIG. 4). Because the loop 32 is cut along the cutting edge 38, which is on one side of the bill 22 and the strand 34 has been lengthened by bending the strand 34 over the upper corner 35, the loop 32 will be cut into a cut pile tuft 40 having substantially equal legs 41, as illustrated in FIG. 11.

The knife 37 is supported in the knife holder 42 (FIG. 1), which in turn is mounted on a knife bar, not shown, which is reciprocably driven by a conventional knife drive mechanism, not shown. The knife drive mechanism is synchronized with the hook bar and the needle drive mechanism, also not shown, in order to reciprocably move the needles 11, the cut pile hooks 18, and the knives 37, to cooperate in timed relationship and in a conventional manner for forming the loops 32 and cutting the same to form the cut pile tufts 40.

In many instances, it has been found in the operation of the machine 10 incorporating the looper mechanism 17 that as the loops 32 are guided over the bills 22, the offset loops 32, as illustrated in FIGS. 3, 4 and 5, tend to pull the base fabric 15 in the same direction. Thus, as the tufting progresses, the base fabric 15 incorporating the cut pile tufts 40 tends to creep gradually transversely toward the same side of the tufting machine 10. Eventually, the tufted pile fabric tends to wrinkle and gather against one side of the machine.

In order to alleviate this "creeping" problem, the needle plate 12 is provided with a plurality of offset needle plate fingers 44. The needle plate fingers 44 are transversely spaced on the same gauge as the needles 11 in such a manner that one needle plate finger 44 projects rearwardly between each adjacent pair of needles 11, as illustrated in FIGS. 2 and 5. Each needle plate finger 44 includes a front straight mounting portion 45, an angular intermediate portion 46, and a rear substantially straight offset portion 47. The offset portions 47 are transversely spaced from the front straight mounting portion 45 in the direction opposite to the direction of pulling of the loop 32 by the straight cutting portion 25 of the corresponding cut pile hook 18, as best illustrated in FIGS. 2 and 5.

Each of the needle plate fingers 44 projects rearwardly far enough to control or pull the loops 32 in the opposite direction from the pull of the hook bill 22 until the loops 32 are cut. After the loops 32 are cut, the looper or cut pile hook 18 no longer controls or engages the cut loops, and therefore there is no longer a necessity for any portion of the needle plate finger 44 rearward of the cutting point.

As disclosed in FIGS. 2 and 5, the intermediate portion 46 of each of the needle plate fingers 44 is substantially straight and disposed at an angle to the straight mounting portion 45, while the rear offset portion 47 is also substantially straight. However, the intermediate portion 46 could be curved, or straight, and disposed at other angles than disclosed in the drawings. It is preferred that the rear offset portion 47 of finger 44 be substantially straight and parallel to the line of stitching in order to produce a uniform transverse pull on the loop 32 to maintain the straight longitudinal course of the base fabric 15. After the loop 32 is cut, the legs 41 of the cut pile tufts 40 are no longer engaged by the offset needle plate finger portion 47 and are restored to their normal line of movement with its corresponding row of stitching, as illustrated in FIG. 5.

FIGS. 6 and 7 disclose substantially the same apparatus as disclosed in FIGS. 1–5, except the looper mechanism 17 includes a cut pile hook 48 having a bill 52 of different configuration from the bill 22. The cut pile hook 48 includes a neck or shank portion 53 and a mounting portion or shank 54 substantially identical in construction to their counterparts 23 and 24 of the hook 18. The bill 52 includes a rear straight cutting portion 55 projecting forward from the shank portion 53 and merging into an intermediate portion 56, which in turn merges into a free end portion 57 terminating in a point 58. The main difference between the bills 52 and 22 is that the intermediate portion 56 gradually curves from its junction with the front portion of the straight bill portion 55 and terminates in the free end portion 57. In other words, the transition between the straight bill portion 55 and the free end portion 57 is smooth and gradual as contrasted with the abrupt changes in the form of the bill 22. Otherwise, the function of the cut pile hooks 48 is identical to the function of the cut pile hooks 18.

In the staggered needle tufting machine 60, portions of which are illustrated in FIGS. 8–10, a transverse row of front needles 61 and a longitudinally spaced row of rear transverse needles 62 are staggered relative to each other, as illustrated in FIG. 9, and supported by the needle bar 63 for vertical reciprocable movement. Each of the front and rear needles 61 and 62 carry corresponding yarns 64 and 65 respectively adapted to be carried through the base fabric 66 supported upon the needle plate 67 for movement longitudinally in the direction of the arrow 68 from front to rear through the machine 60.

The looper mechanism 70 includes a plurality of transversely spaced cut pile hooks 71 and 72, which are substantially identical to the cut pile hooks 18 and 48, respectively.

The bills of the long cut pile hooks 71 are longer than the bills of the short cut pile hooks 72 by an amount equal to the longitudinal offset between the front and rear needles 61 and 62, so that the cut pile hooks 71 and 72 may cooperate with their corresponding front and rear needles 61 and 62 to form yarn loops 73 and 74, respectively.

The short cut pile hook 72 may be identical in shape to the cut pile hook 48, and includes a short bill 75 projecting forward from the throat portion 76 which is connected to the rearward projecting shank or mounting element 77 received in the hook bar 19.

As illustrated in the drawings, and particularly FIG. 9, the short bill 75 is provided with a substantially straight rear cutting portion 78 and an angular curved intermediate portion 79 which terminates in the free end portion 80. Because of the short length of the bill 75, the intermediate portion 79 is relatively short, and the free end portion 80 and pointed end 81 are essentially the free end of the intermediate portion 79. As illustrated in FIG. 9, the intermediate portion 79 gradually merges with the rear straight cutting portion 78. The intermediate portion 79 is relatively short because of its proximity to the flat cutting surface 82 of the straight cutting portion 78 against which the knife 37 reciprocates for cutting the loop 74.

The long cut pile hooks 71 may be identical in shape to the cut pile hooks 18. The cut pile hooks 71 are adapted to cooperate with the front needles 61 and have neck and shank portions identical to the neck and shank portions 76 and 77 of the hook 72. However, the long bill 84 of the hook 71 has a rear straight cutting portion 85, an angular intermediate portion 86, a free end portion 87, and a pointed end 88 similar to those incorporated in the hook 18.

As disclosed in the drawings, and particularly in FIG. 9, the lengths of the straight cutting portions 78 and 85 of the short and long hooks 72 and 71 are substantially equal so that they are in constant engagement with their corresponding knives 37, which are in transverse alignment in the staggered needle machine 60.

Otherwise, the cut pile hooks 71 and 72 cooperate with their respective front and rear needles 61 and 62 in the same manner as the cut pile hooks 18 and 48 cooperate with the needles 11, 61 and 62, in order to form cut pile tufts 40 having legs 41 of equal height or length.

Although a conventional needle plate 67 having needle fingers 90 is disclosed in FIG. 8, nevertheless, a needle plate having offset fingers may be incorporated within the staggered needle machine 60 if such staggered needle plate fingers 44 are necessary in order to prevent lateral drifting or creeping of the base fabric 66. An offset finger for a staggered needle tufting machine may have a straight mounting portion extending rearward between each pair of front needles 61 and an angular portion projecting rearward from the mounting portion and between an adjacent pair of rear needles 62.

Generally, long-billed cut pile hooks, such as hooks 71 are necessary only in staggered needle machines 60 for cooperation with the front needles 61. Short-billed hooks are generally used in in-line tufting machines 10. However, a long-billed offset hook such as hook 18 may be effectively used in an in-line machine 10 where additional clearance between the hook and needle is required.

It has been found that tufted cut pile fabric having a very smooth and uniform cut pile surface can be produced in relatively narrow or fine gauges by virtue of the utilization of the above-described looper mechanisms having the cut pile hooks with their laterally offset bills. The bills may be formed by bending at the appropriate points to form the corresponding straight cutting portion, intermediate portion and free end portion.

All of the cut pile hooks are mounted laterally offset from their normal conventional positions to place the free end portions of the hooks in proper position for crossing, engaging and seizing the loops formed by the needles after the needles have penetrated the base fabric.

Finer gauges are permitted because no additions are made to the loopers per se. Only the existing bills are bent or deformed, so that the free end portion is transversely or laterally offset from the straight cutting portion of the bill.

In actual trials, a staggered needle tufting machine, such as that illustrated in FIGS. 8–10, has been successfully producing one-tenth gauge cut pile tufted fabrics.

By virtue of the substantial elimination of the "J-cut" by the tufting machines and looper apparatus made in accordance with this invention, larger, less expensive yarns may be utilized. Relatively fine yarns are more expensive per pound and create more operating problems and more down time for tufting machines than relatively coarser yarns. Previously, where relatively large yarns were used, the "J-cuts" were more pronounced, because the larger the yarn, the greater the differential between the short and long legs of the cut pile tufts.

By using coarser or larger diameter yarns, fewer needles and cooperating loopers and knives may be used in a tufting machine for a given fabric width.

Moreover, for a given fabric area, less coarse yarn than fine yarn may be used.

What is claimed is:

1. In a tufting machine having a plurality of reciprocable needles for introducing yarns through a base fabric movable longitudinally front-to-rear through the machine to form transversely spaced longitudinal rows of loops, and fabric support means for supporting the base fabric beneath the needle, a looper apparatus comprising:

(a) a cut pile hook for each needle having an elongated bill, a throat portion, and a mounting portion, (b) said bill having an elongated cutting portion projecting forward from said throat portion, and a free end portion offset transversely from said cutting portion, said bill being adapted to extend through a loop of yarn formed by a corresponding needle, (c) said cutting portion having a cutting surface on the opposite side of said bill from said end portion, (d) mounting means supporting said mounting portion for reciprocable movement of said cut pile hook between a forward operative position and a rearward inoperative position, whereby said free end portion travels in a longitudinal point path closely adjacent one side of a corresponding needle in its lowermost reciprocable position for seizing a loop formed on said corresponding needle in said operative position, and said cutting portion travels in a longitudinal offset path spaced transversely from said point path, (e) a knife member, and (f) means for relatively moving said knife member against said cutting surface in a cutting position when said hook is in said rearward inoperative position to cut a loop on said bill to form a cut pile tuft having legs of substantially equal length.

2. The invention according to claim 1 in which said cutting portion has a transverse dimension and a vertical dimension substantially greater than said transverse dimension.

3. The invention according to claim 1 in which said bill further comprises an intermediate portion connecting said free end portion and said cutting portion, said intermediate portion being at an angle to said cutting portion.

4. The invention according to claim 3 in which said cutting portion, said intermediate portion and said free end portion are integral.

5. The invention according to claim 4 in which said bill is bent to form said cutting, intermediate, and free end portions.

6. The invention according to claim 5 in which said bill has a pair of longitudinally spaced bends to form a substantially straight intermediate portion and a substantially straight free end portion.

7. The invention according to claim 4 in which said intermediate portion is transversely curved.

8. The invention according to claim 1 further comprising the fabric support means, said fabric support means comprising a needle plate having a plurality of needle plate fingers, each finger projecting rearward between an adjacent pair of reciprocable needles and above said hooks, said fingers terminating in rear edges spaced substantially vertically above said cutting positions.

9. The invention according to claim 8 in which each of said fingers comprises a substantially straight finger mounting portion extending between adjacent pairs of needles and a rear offset portion spaced transversely from said finger mounting portion on the opposite side of said hook from said knife member.

10. The invention according to claim 9 in which said finger has an intermediate portion connecting said finger mounting portion and said rear offset portion.

11. The invention according to claim 1 in which the tufting machine is a staggered needle tufting machine having a front transverse row of uniformly spaced reciprocable front needles and a rear row of uniformly spaced reciprocable rear needles uniformly offset from the front needles, said cut pile hooks comprising a first set of cut pile hooks, each of which is adapted to cooperate with a corresponding front needle for forming a yarn loop, and a second set of cut pile hooks adapted to cooperate with said rear needles for forming a second row of loops, the bills of said first set of hooks being longer than the bills of said second hooks, the free end portions of the bills of said first and second sets of hooks being spaced transversely in the same direction from the cutting portions of the bills of said corresponding hooks.

12. The invention according to claim 11 in which the free end portions of adjacent bills have substantially the same gauge and the same longitudinal offset as the corresponding front and rear needles.

13. The invention according to claim 11 in which each of said bills of both sets of hooks comprises an intermediate portion connecting the cutting portions and free end portions of said corresponding hooks.

14. The invention according to claim 12 in which the front extremities of said cutting portions are forward of any portion of said knife member in said cutting position.

* * * * *